US006530647B2

(12) United States Patent
Kubota et al.

(10) Patent No.: US 6,530,647 B2
(45) Date of Patent: Mar. 11, 2003

(54) COLOR INK-JET HEAD

(75) Inventors: Atsushi Kubota, Shizuoka-ken (JP); Masashi Shimosato, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/004,677

(22) Filed: Oct. 29, 2001

(65) Prior Publication Data

US 2002/0051033 A1 May 2, 2002

(30) Foreign Application Priority Data

Nov. 1, 2000 (JP) ..... 2000-335089

(51) Int. Cl.[7] ..... B41J 2/155

(52) U.S. Cl. ..... 347/43; 347/15; 347/43; 347/42; 347/12; 347/13; 347/40

(58) Field of Search ..... 347/15, 43, 42, 347/12, 13, 40, 49

(56) References Cited

U.S. PATENT DOCUMENTS 4,604,654 A * 8/1986 Sakurada et al. ..... 358/298
5,361,084 A * 11/1994 Paon et al. ..... 347/15
5,742,304 A 4/1998 Richtsmeier et al. ..... 347/40
6,209,985 B1 * 4/2001 Minamizawa ..... 347/40
6,250,738 B1 6/2001 Waller et al. ..... 347/42
6,264,305 B1 * 7/2001 Inui et al. ..... 347/43
6,299,287 B1 * 10/2001 Williams ..... 347/43

FOREIGN PATENT DOCUMENTS

JP 6-226998 8/1994
JP 2000-25207 1/2000

* cited by examiner

*Primary Examiner*—Lamson Nguyen
(74) *Attorney, Agent, or Firm*—Frishauf, Holtz, Goodman & Chick, P.C.

(57) ABSTRACT

A color ink-jet head is provided which includes: a plurality of head units each having 1/n of a total number of nozzles predetermined as a maximum number to jet ink of one color in one scanning, where n is an integer equal to or greater than 2, and wherein the nozzles of each of the head units are arranged at a same pitch; and a plurality of head blocks each having at least as many head units as a number of different ink colors to be used for the ink-jet head. The head units are provided for holding respective inks of the different ink colors and are arranged in a direction perpendicular to a printing direction of the ink-jet head. A predetermined number of head blocks are arranged in the printing direction in such a manner that no head units of a same color are aligned in the printing direction, and the head blocks execute printing for the predetermined number of head blocks multiplied by 1/n of a printing width in one scanning.

22 Claims, 10 Drawing Sheets

COLOR INK-JET HEAD

CROSS-REFERENCE TO RELATED APPLICATIONS

This application is based upon and claims the benefit of priority from the prior Japanese Patent Application No. 2000-335089, filed Nov. 1, 2000, the entire contents of which are incorporated herein by reference.

BACKGROUND OF THE INVENTION

1. Field of the Invention

This invention relates to a color ink-jet head to be suitably used for a printing machine, a copying machine, a facsimile set, a plotter or the like.

2. Description of the Related Art

The ink-jet printing technology is being popularly used for color printing machines because it facilitates color printing. In recent years, the number of nozzles of color printing machine for ejecting ink droplets has been increased remarkably to meet the demand for high resolution and high speed printing. Accordingly, large ink-jet heads provided with a huge number of nozzles have been developed. However, such complex ink-jet heads entails a poor manufacturing yield and hence is costly. Thus, efforts have been paid to develop ink-jet heads comprising a plurality of head units, each having a relatively small number of nozzles in an attempt at reducing the manufacturing cost. For instance, a color ink-jet head can be produced by preparing large head blocks, each comprising a plurality of head units having relatively small number of nozzles, and arranging as many head blocks as the number of ink colors to be used for the ink-jet head. Such a color ink-jet head operates just like a color ink-jet head formed by arranging as many large heads as the number of ink colors to be used for the color ink-jet head.

Meanwhile, there are low speed machines, standard speed machines and high speed machines comprising a color ink-jet head. Of these, low speed printing machines use only a small number of nozzles, whereas high speed printing machines requires a large number of nozzles so that a large number of pixels may be produced by each printing operation, which needs to be conducted at high speed.

Conventionally, low speed machines, standard speed machines and high speed machines are realized either by differentiating the head lengths as shown in FIGS. 14A, 14B and 14C of the accompanying drawing or by differentiating the number of head units, or using head blocks with different lengths, as shown in FIGS. 15A, 15B and 15C of the accompanying drawing. Note that, in FIGS. 14A through 15C, reference symbol B denotes a head unit using black ink and reference symbol Y denotes a head unit using yellow ink, while reference symbols M and C respectively denote a head unit using magenta ink and a head unit using cyan ink.

However, the head units of the machines shown in FIGS. 14A through 14C have respective heads with a length differentiated for the low speed machine, the standard speed machine and the high speed machine. In other words, low speed machines, standard speed machines and high speed machines require manufacture of respective dedicated heads, which is an operation entailing a low economic efficiency and a high manufacturing cost. Similarly, in the case of printing machines adapted to use head blocks, different dedicated head blocks as shown in FIGS. 15A through 15C have to be prepared for the low speed machine, the standard speed machine and the high speed machine. The net result will also be a low economic efficiency and a high manufacturing cost.

The problem of low economic efficiency and high cost also arises when the number of heads is doubled for the low speed machine, the standard speed machine and the high speed machine in such a way that the nozzles of one of the head groups and those of the other head group are arranged alternately to halve the pitch of nozzle arrangement and double the resolution because the number of dedicated heads or head blocks have to be increased for each of the low speed machine, the standard speed machine and the high speed machine.

BRIEF SUMMARY OF THE INVENTION

In view of the above identified circumstances, it is therefore the object of the present invention to provide a color ink-jet head that can be realized by using a plurality of identical head blocks regardless if it is used for a high speed machine, a standard speed machine or a low speed machine to consequently raise the economic efficiency and lower the cost.

According to one aspect of the present invention, the above object is achieved by providing a color ink-jet head comprising: a plurality of head units each having 1/n of a total number of nozzles predetermined as a maximum number to jet ink of one color in one scanning, where n is an integer equal to or greater than 2, and wherein the nozzles of each of the head units are arranged at a same pitch; and a plurality of head blocks each having at least as many said head units as a number of different ink colors to be used for the ink-jet head. The head units are provided for holding respective inks of the different ink colors and are arranged in a direction perpendicular to a printing direction of the ink-jet head. A predetermined number of said head blocks are arranged in the printing direction in such a manner that no head units of a same color are aligned in the printing direction, and said head blocks execute printing for said predetermined number of head blocks multiplied by 1/n of a printing width in one scanning.

Additional objects and advantages of the invention will be set forth in the description which follows, and in part will be obvious from the description given above or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 2 is a schematic illustration of the embodiment of FIG. 1, showing the configuration there of;

DETAILED DESCRIPTION OF THE INVENTION

Now, the present invention will be described in greater detail by referring to the accompanying drawing that illustrates preferred embodiments of the invention.

(First Embodiment)

Figure 1:
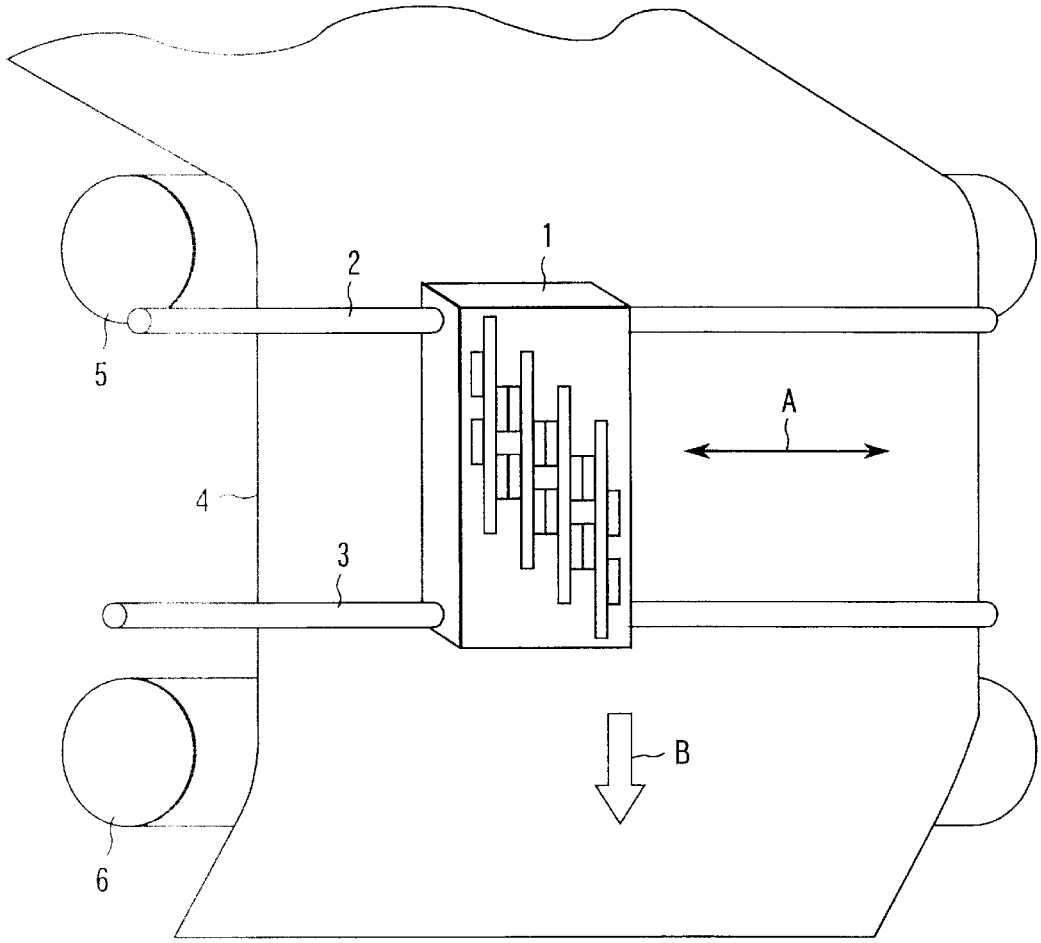
FIG. 1 is a schematic perspective view of a color ink-jet head according to the first embodiment of the invention, showing the configuration of a principal part of the printing section thereof.

FIG. 1 is a schematic perspective view of a color ink-jet head according to the first embodiment of the invention, showing the configuration of a principal part of the printing section thereof. Referring to FIG. 1, the color ink-jet head 1 is slidable on a pair of rails 2, 3. The color ink-jet head 1 is driven to move on the rails 2, 3 in the directions indicated by arrow A in FIG. 1 for printing operations. In FIG. 1, the recording medium 4 denotes a recording medium such as a web of recording paper that is driven to move in the direction indicated by arrow B in FIG. 1 in the printing operation.

Thus, the color ink-jet head 1 is driven to move right and left in FIG. 1 on the rails 2, 3 to perform a cycle of printing operation on the recording medium 4. As the color ink-jet head 1 completes the cycle of operation, the recording medium 4 is moved forward by a predetermined distance and then the color ink-jet head 1 is driven again to move right and left and performs another cycle of printing operation on the recording medium 4 along a zone adjacent to the zone where the preceding cycle of printing operation is performed. The intended entire printing operation is carried out by repeating such a cycle of operation.

Figure 2:
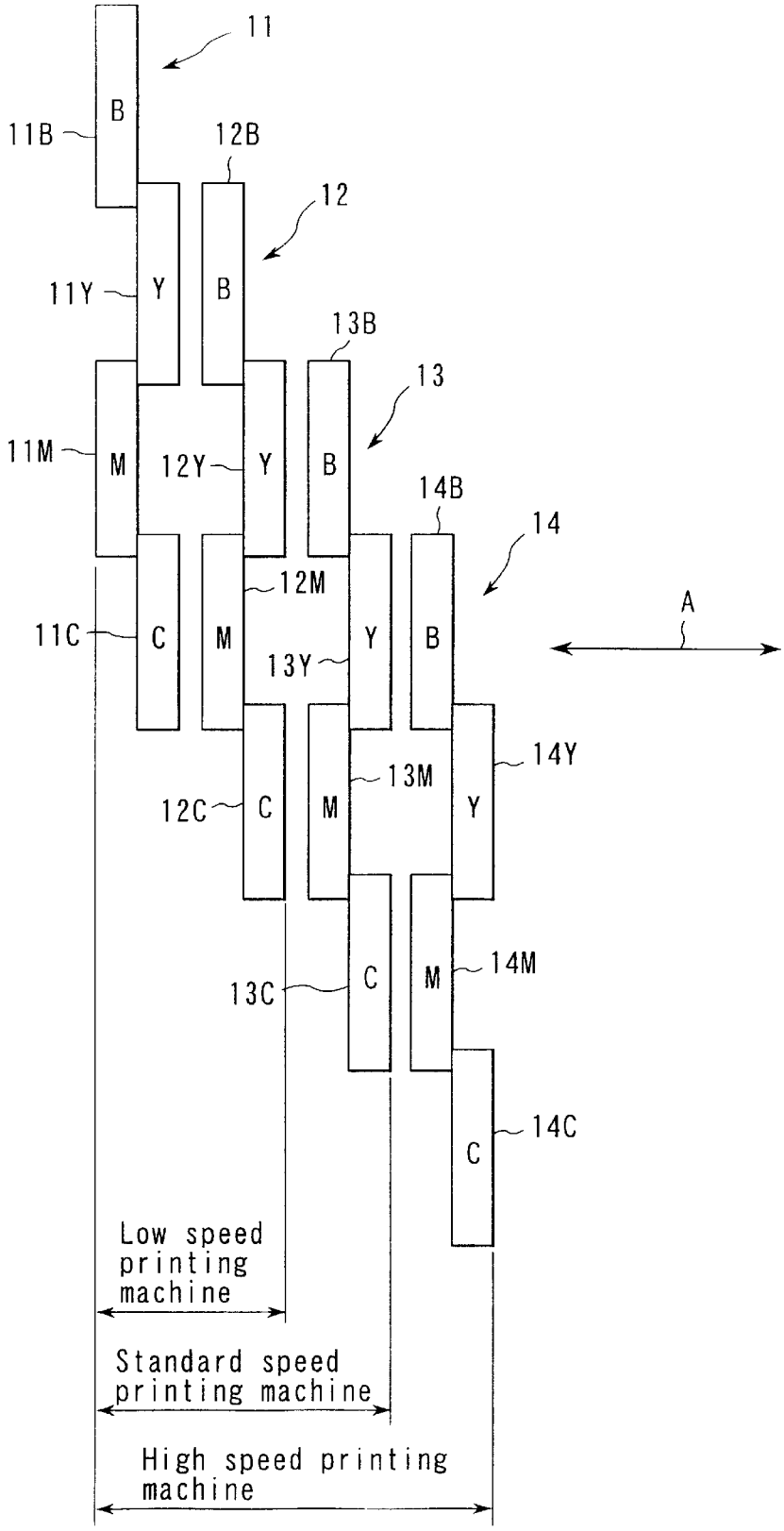

FIG. 2 is a schematic illustration of the above embodiment of color ink-jet head of FIG. 1, showing the entire configuration thereof. The color ink-jet head 1 comprises a total of four head blocks, each having four head units for four different colors. In other words, n=4. All the four head units show a same length, a a same number of nozzles-arranged at a same and identical pitch. Assume here that each head unit has 100 nozzles.

More specifically, the first head block 11 is formed by arranging a head unit 11B for black ink, a head unit 11Y for yellow ink, a head unit 11M for magenta ink and a head unit 11C for cyan ink in a direction perpendicular to the printing direction (as indicated by arrow A in FIG. 2) in the above mentioned order.

Similarly, the second head block 12 is formed by arranging a head unit 12B for black ink, a head unit 12Y for yellow ink, a head unit 12M for magenta ink and a head unit 12C for cyan ink in a direction perpendicular to the printing direction in the above mentioned order.

Likewise, the third head block 13 is formed by arranging a head unit 13B for black ink, a head unit 13Y for yellow ink, a head unit 13M for magenta ink and a head unit 13C for cyan ink in a direction perpendicular to the printing direction in the above mentioned order.

Finally, the fourth head block 14 is formed by arranging a head unit 14B for black ink, a head unit 14Y for yellow ink, a head unit 14M for magenta ink and a head unit 14C for cyan ink in a direction perpendicular to the printing direction in the above mentioned order.

Figure 3A:
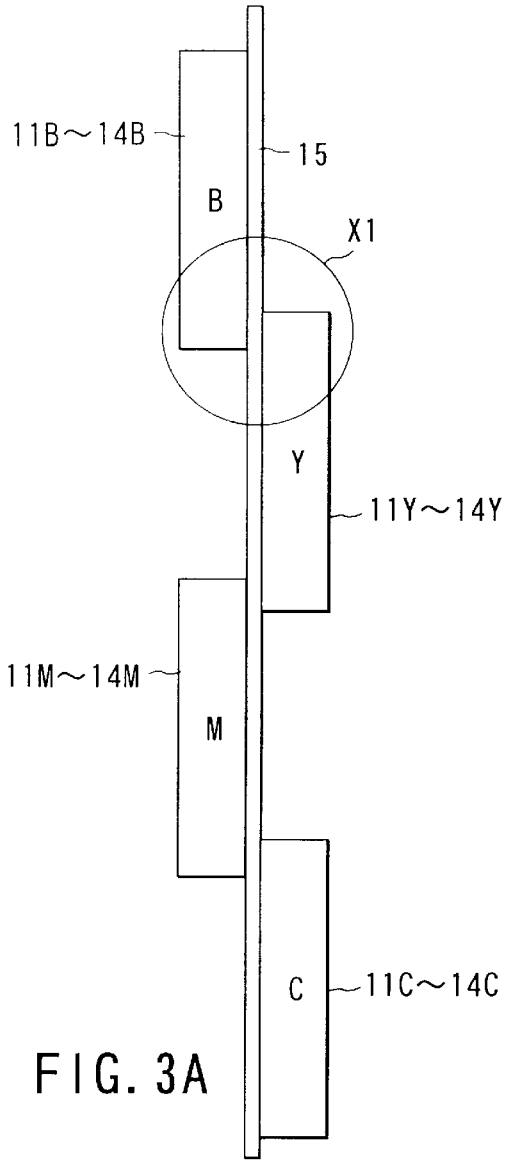
FIGS. 3A and 3B are schematic illustrations of head blocks that can be used for the embodiment of FIG. 1, showing the configuration thereof.

Then, as shown in FIG. 3A, in each of the head blocks 11, 12, 13, 14, the head unit 11B, 12B, 13B or 14B for black ink and the head unit 11M, 12M, 13M or 14M, whichever appropriate, for magenta ink are located at a side of the block base 15, while the head unit 11Y, 12Y, 13Y or 14Y, whichever appropriate, for yellow ink and the head unit 11C, 12C, 13C or 14C, whichever appropriate, for cyan ink are located at the opposite side of the block base 15, the head units being arranged in the order of black (B), yellow (Y), magenta (M) and cyan (C) as shown in FIG. 3A.

Figure 3B:
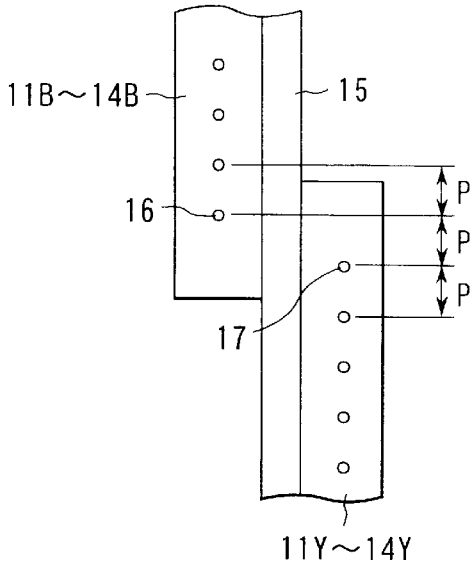

FIG. 3B is an enlarged schematic illustration of a part of the embodiment, surrounded by a circle and indicated by $X_1$ in FIG. 3A. Referring to FIG. 3B, the extreme end nozzles 16 of the head unit 11B, 12B, 13B or 14B for black ink and the extreme end nozzles 17 of the head unit 11Y, 12Y, 13Y or 14Y, whichever appropriate, are arranged at a same and identical nozzle pitch of P. Therefore, when viewed from a lateral side, the head unit B, 12B, 13B or 14B for black ink and the head unit 11Y, 12Y, 13Y or 14Y, whichever appropriate, for yellow ink overlap each other to some extent at the respective ends located close to each other.

The above described positional relationship applies equally to the nozzles of the head unit 11Y, 12Y, 13Y or 14Y, whichever appropriate, for yellow ink and those of the head unit 11M, 12M, 13M or 14M, whichever appropriate, for magenta ink and to the nozzles of the head unit 11M, 12M, 13M or 14M, whichever appropriate, for magenta ink and those of the head unit 11C, 12C, 13C or 14C, whichever appropriate, for cyan ink.

Then, the head blocks 11 through 14 are displaced sequentially and slightly relative to each other in a direction perpendicular to the printing direction of the ink-jet head by a distance equal to the length of a head unit so that the second head unit of the first head block and the first head unit of the second head block are exactly aligned in the printing direction and so on.

Figure 4:
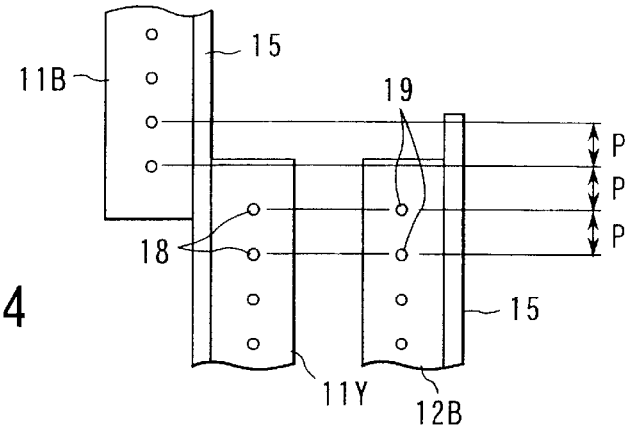
FIG. 4 is a schematic illustration of head blocks that can be used for the embodiment of FIG. 1, showing the positional relationship of nozzles thereof.

More specifically, as shown in FIG. 4, the nozzles 18 of the head unit 11Y for yellow ink, or the second head unit, of the first head block 11 are aligned respectively with the corresponding nozzles 19 of the head unit 12B for black ink, or the first head unit, of the second head block 12 in the printing direction.

Similarly, the nozzles of the head unit 12Y for yellow ink, or the second head unit, of the second head block 12 are aligned respectively with the corresponding nozzles of the head unit 13B for black ink, or the first head unit, of the third head block 13 in the printing direction. Likewise, the nozzles of the head unit 13Y for yellow ink, or the second head unit, of the third head block 13 are aligned respectively with the corresponding nozzles of the head unit 14B for black ink, or the first head unit, of the fourth head block 14.

The number of nozzles of each head unit may be determined by taking the manufacturing facility, the manufacturing yield, the smallest possible number of nozzles according to the specifications of the printing machine, 1/n (n=an integer equal to or greater than 2) of the largest possible number of nozzles according to the specifications of the printing machine and so on into consideration. If each head unit contains dummy nozzles, the largest possible number may not be exactly dividable by the integer n. Then, the number of nozzles may be determined to be equal to an integer close to the quotient obtained by dividing the largest possible number by the integer n.

With the color ink-jet head 1 having the above described configuration, four head units are arranged in a direction perpendicular to the printing direction of the ink-jet head for each of the ink colors of black (B), yellow (Y), magenta (M) and cyan (C), although the head units of a same color may be separated considerably in the printing direction, and all the nozzles are arranged at a same and identical pitch of P. Therefore, a cycle of printing operation is carried out properly with a width substantially equal to that of four head units arranged side by side when the timing of ejection of ink of each color from the nozzles of each head unit is properly controlled. Thus, a high speed printing machine can be realized by using this embodiment of color ink-jet head according to the invention. There may be cases where dummy nozzles are used. Then, the total number of nozzles may not be exactly dividable by n and equal to 402 for ink of each color for instance. However, no problem arises when n=4 is used for such a case.

As pointed out above, all the head blocks have a same and identical configuration. Therefore, if the color ink-jet head is made to comprise three head blocks by removing a head block from the above described embodiment of color ink-jet head, a cycle of printing operation is carried out properly with a width substantially equal to that of three head units arranged side by side when the timing of ejection of ink of each color from the nozzles of each head unit is properly controlled. Then, a standard speed printing machine can be realized by using such a color ink-jet head. Furthermore, if the color ink-jet head is made to comprise only two head blocks by removing one head block from the above described embodiment of color ink-jet head, a cycle of printing operation is carried out properly with a width substantially equal to that of two head units arranged side by side when the timing of ejection of ink of each color from the nozzles of each head unit is properly controlled. Then, a low speed printing machine can be realized by using such a color ink-jet head.

In this way, the color ink-jet head for high speed printing machines, that for standard speed printing machines and that for low speed printing machines can be produced by using different number of head blocks having a same and identical configuration. In other words, it is no longer necessary to produce head blocks dedicated to a high speed printing machine, a standard speed printing machine or a low speed printing machine. Then, color ink-jet heads can be manufactured at low cost to realize a high economic efficiency.

The rate at which ink is ejected from the nozzles of a color ink-jet head may be modified from time to time. For example, in the case of a large printing machine for printing posters, ink will be ejected at a high rate to print a highly dense picture, although then the applied ink can flow out from the proper areas on the poster even to the rear side of thereof, because the poster is normally viewed by viewers standing at positions considerably remote from it. On the other hand, printing machines that are installed in offices should eject at a lower rate in order to avoid any undesired flow of ink because the characters printed on sheets of paper by the printing machine is normally read from a short distance and pictures and characters may be printed on the two sides of each sheet of paper.

Thus, the rate at which ink is to be ejected from the nozzles of a color ink-jet head can vary significantly depending on the printed matters that will come out from the printing machine. While the requirement for changing the rate of ink ejection may be partly accommodated by selecting an appropriate recording medium, which may normally be recording paper, the rate of ink ejection of a color ink-jet head nevertheless needs to be made variable to a considerable extent. While the rate of ink ejection may be modified by using different heads with different nozzle diameters, such an arrangement requires manufacture of heads with different nozzle diameters to contradict the attempt at reducing the manufacturing cost and raising the economic efficiency.

The printing density can be varied by using a single head that is adapted to control the gradation and hence whose rate of ink ejection for printing a single pixel is variable. There are two types of ink-jet heads adapted to control the gradation of the printed image. One is the multi-drop type ink-jet head, with which ink droplets are ejected sequentially from a nozzle to form a pixel (dot) and the number of ink droplets can be controlled to produced the required gradation. The other is the volume control type ink-jet head, with which the size of the ink droplet being ejected from a nozzle is controlled by selectively using an appropriate voltage and an appropriate duration of time of voltage application to control the internal pressure of the ink chamber.

Either of the above described two types can be applied to each head unit of each head block of this embodiment of color ink-jet head 1. Therefore, a high speed printing machine, a standard speed printing machine or a low speed printing machine can be realized in an easy way by using a color ink-jet head according to the invention and adapted to control the gradation of the printed image.

(Second Embodiment)

Figure 5:
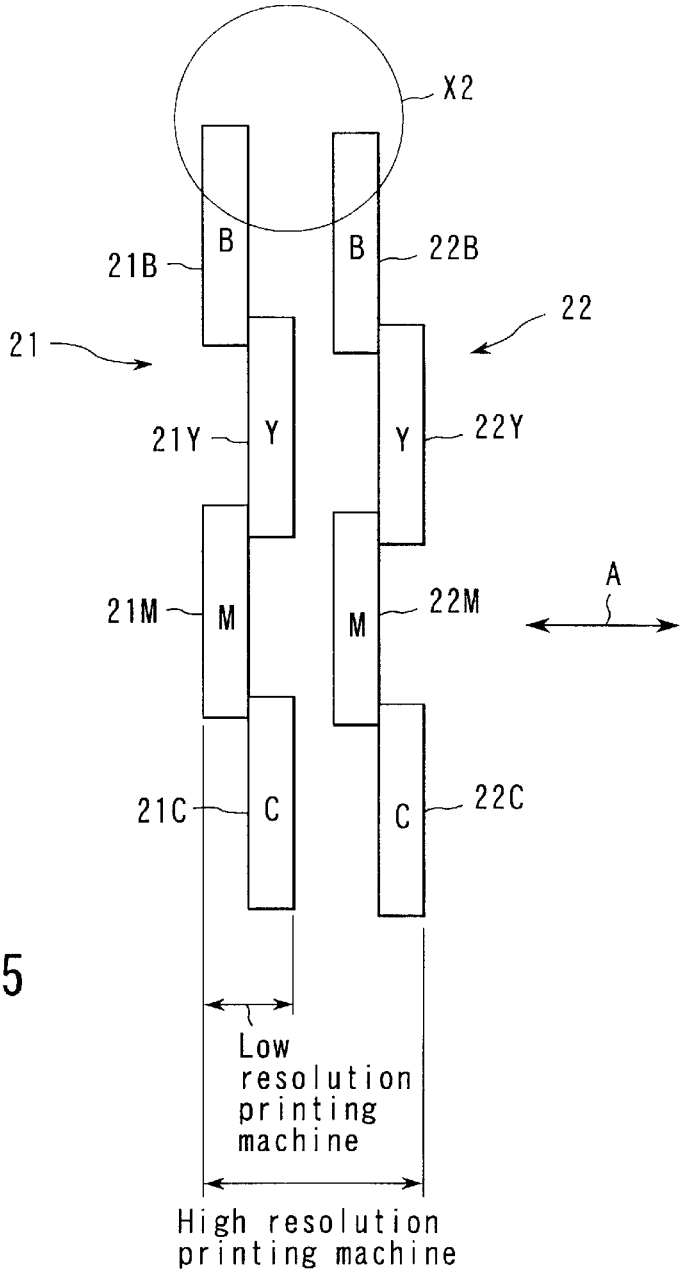
FIG. 5 is a schematic illustration of a color ink-jet head according to the second embodiment of the invention, showing the configuration thereof.

FIG. 5 is a schematic illustration of a color ink-jet head according to the second embodiment of the invention, showing the configuration thereof. This embodiment of color ink-jet head comprises two head blocks, each having four head units for four different colors. The four head units show a same length, a same number of nozzles arranged at a same and identical pitch.

More specifically, the first head block 21 is formed by arranging a head unit 21B for black ink, a head unit 21Y for yellow ink, a head unit 21M for magenta ink and a head unit 21C for cyan ink in a direction perpendicular to the printing direction (as indicated by arrow A in FIG. 5) in the above mentioned order.

Similarly, the second head block 22 is formed by arranging a head unit 22B for black ink, a head unit 22Y for yellow ink, a head unit 22M for magenta ink and a head unit 22C for cyan ink in a direction perpendicular to the printing direction in the above mentioned order.

Figure 6:
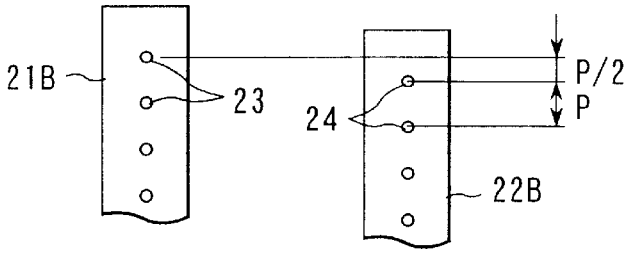
FIG. 6 is a schematic illustration of head blocks that can be used for the embodiment of FIG. 5, showing the positional relationship of nozzles thereof.

The head blocks 21, 22 are displaced slightly in a direction perpendicular to the printing direction. FIG. 6 is a schematic illustration of head blocks that can be used for the embodiment of FIG. 5, showing the positional relationship thereof. Note that FIG. 6 is an enlarged schematic illustration of a part of the embodiment, surrounded by a circle and indicated by $X_2$ in FIG. 5. Referring to FIG. 6, the nozzles 23 of the head unit 21B for black ink of the first head block 21 are displaced respectively from the corresponding nozzles 24 of the head unit 22B for black ink of the second head block 22 by a half of the nozzle pitch P at which the nozzles 23 and 24 are arranged.

Similarly, the nozzles of the head unit 21Y for yellow ink, those of the head unit 21M for magenta ink and those of the head unit 21C for cyan ink of the first head block 21 are displaced respectively from the corresponding nozzles of the head unit 22Y for yellow ink, those of the head unit 22M for magenta ink and those of the head unit 22C for cyan ink of the second head block 22 by a half of the nozzle pitch P of arrangement of the nozzles.

With this arrangement, the pixels printed by the first head block 21 and those printed by the second head block 22 are located alternately as viewed in the printing direction so that pixels can be printed at a pitch of P/2, or twice of the resolution of each head block. In other words, a high resolution printing machine can be realized by using two identical head blocks. Differently stated, a low resolution printing machine can be realized by using a single head block.

An even higher resolution can be realized by using three identical head blocks that are arranged in such a way that the nozzles of each of the head blocks are displaced from those of the remaining head blocks by one-third of the nozzle pitch P of arrangement of the nozzles of each head block. Generally speaking, a color ink-jet head showing a resolution n times as high as that of a single head block can be realized by using n head blocks (n=an integer equal to or greater than two) and displacing the nozzles of each of the head blocks from those of the remaining head blocks by 1/n of the nozzle pitch P of arrangement of the nozzles of each head block.

Thus, a high resolution printing machine or a low resolution printing machine can be manufactured simply by using an appropriate number of head blocks having a same and identical configuration. Then, color ink-jet heads can be manufactured at low cost to realize a high economic efficiency.

Either of the above described two types, the multi-drop type or the volume control type, can be applied to each head unit of each head block of this embodiment of color ink-jet head for the purpose of gradation control.

(Third Embodiment)

Figure 7:
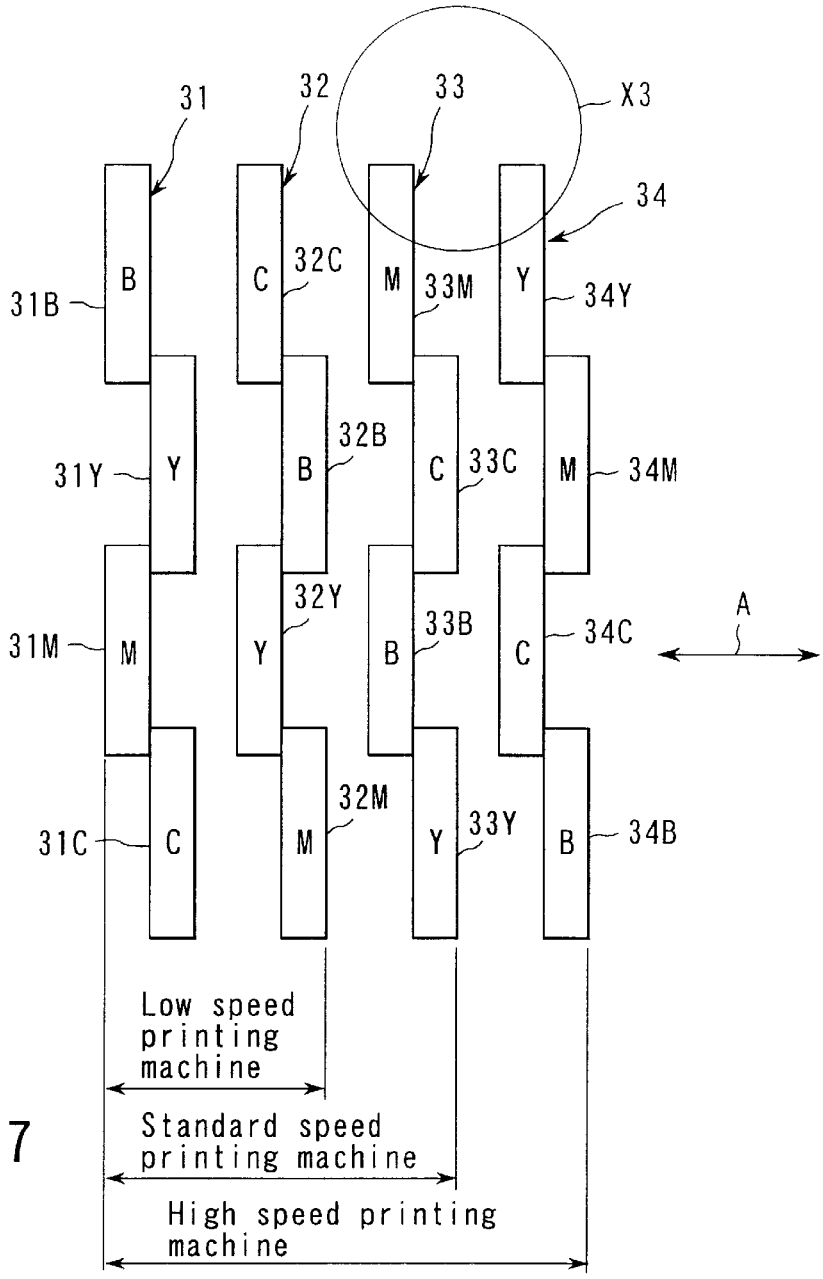
FIG. 7 is a schematic illustration of a color ink-jet head according to the third embodiment of the invention, showing the configuration thereof.

FIG. 7 is a schematic illustration of a color ink-jet head according to the third embodiment of the invention, showing the configuration thereof. As shown in FIG. 7, this embodiment of color ink-jet head includes a total of four head blocks, each having four head units for four different colors. All the four head units show a same length, a same number of nozzles arranged at a same and identical pitch. The head blocks are arranged in such a way that no two head units of a same color does not come on a same line in the printing direction.

More specifically, the first head block 31 is formed by arranging a head unit 31B for black ink, a head unit 31Y for yellow ink, a head unit 31M for magenta ink and a head unit 31C for cyan ink in a direction perpendicular to the printing direction (as indicated by arrow A in FIG. 7) in the above mentioned order.

Similarly, the second head block 32 is formed by arranging a head unit 32C for cyan ink, a head unit 32B for black ink, a head unit 32Y for yellow ink and a head unit 32M for magenta ink in a direction perpendicular to the printing direction in the above mentioned order.

Likewise, the third head block 33 is formed by arranging a head unit 33M for magenta ink, a head unit 33C for cyan ink, a head unit 33B for black ink and a head unit 33Y for yellow ink in a direction perpendicular to the printing direction in the above mentioned order.

Finally, the fourth head block 34 is formed by arranging a head unit 34Y for yellow ink, a head unit 34M for magenta ink, a head unit 34C for cyan ink and a head unit 34B for black ink in a direction perpendicular to the printing direction in the above mentioned order.

The arrangement of head units in each of the head blocks 31 through 34 and the pitch of arrangement of nozzles are same as those shown in FIG. 3A.

Figure 8:
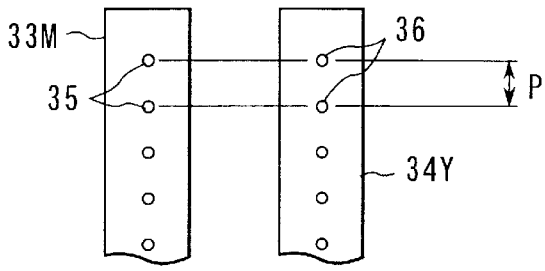
FIG. 8 is a schematic illustration of head blocks that can be used for the embodiment of FIG. 7, showing the positional relationship of nozzles thereof.

However, the head blocks 31 through 34 of this embodiment are aligned in the printing direction. FIG. 8 is a schematic illustration of head blocks that can be used for the embodiment of FIG. 7, showing the positional relationship thereof. Note that FIG. 8 is an enlarged schematic illustration of a part of the embodiment, surrounded by a circle and indicated by $X_3$ in FIG. 7. Referring to FIG. 8, the nozzles 35 of the head unit 33M for magenta ink of the third head block 33 are aligned respectively with the corresponding nozzles 36 of the head unit 34Y for yellow ink of the fourth head block 34 in the printing direction. Similarly, the nozzles of the head unit 31B for black ink of the first head block 31 and those of the head unit 32C for cyan ink of the second head block 32 are aligned respectively with the corresponding nozzles 35 of the head unit 33M for magenta ink of the third head block 33 in the printing direction.

With the color ink-jet head having the above described configuration, four head units are arranged in a direction perpendicular to the printing direction of the ink-jet head for each of the ink colors of black (B), yellow (Y), magenta (M) and cyan (C), although the head units of a same color may be separated considerably in the printing direction, and all the nozzles are arranged at a same and identical pitch of P. Therefore, a cycle of printing operation is carried out properly with a width substantially equal to that of four head units arranged side by side when the timing of ejection of ink of each color from the nozzles of each head unit is properly controlled. Thus, a high speed printing machine can be realized by using this embodiment of color ink-jet head according to the invention. When, for example, 400 nozzles are used for ink of each color in a high speed printing machine comprising this embodiment of color ink-jet head, n=4 will be selected for it. There may be cases where dummy nozzles are used. Then, the total number of nozzles may not be exactly dividable by n and equal to 402 for ink of each color for instance with two dummy nozzles. However, no problem arises when n=4 is used for such a case.

As pointed out above, all the head blocks have a same and identical configuration. Therefore, if the color ink-jet head is made to comprise three head blocks by removing a head block from the above described embodiment of color ink-jet head, a cycle of printing operation is carried out properly with a width substantially equal to that of three head units arranged side by side when the timing of ejection of ink of each color from the nozzles of each head unit is properly controlled. Then, a standard speed printing machine can be realized by using such a color ink-jet head. Furthermore, if the color ink-jet head is made to comprise only two head blocks by removing one head block from the above described embodiment of color ink-jet head, a cycle of printing operation is carried out properly with a width substantially equal to that of two head units arranged side by side when the timing of ejection of ink of each color from the nozzles of each head unit is properly controlled. Then, a low speed printing machine can be realized by using such a color ink-jet head.

In this way, heads for high speed printing machines, those for standard speed printing machines and those for low speed printing machines can be produced by using different order of arrangement of the colors of ink of head blocks having a same and identical configuration. In other words, it is no longer necessary to produce head blocks dedicated to a high speed printing machine, a standard speed printing machine or a low speed printing machine. Then, color ink-jet heads can be manufactured at low cost to realize a high economic efficiency. Additionally, since the head blocks are not displaced but exactly aligned relative to each other in a direction perpendicular to the printing direction, the length of the entire head can be made substantially as short as that of a head block.

Either of the above described two types, the multi-drop type or the volume control type, can be applied to each head unit of each head block of this embodiment of color ink-jet head for the purpose of gradation control.

(Fourth Embodiment)

Figure 9:
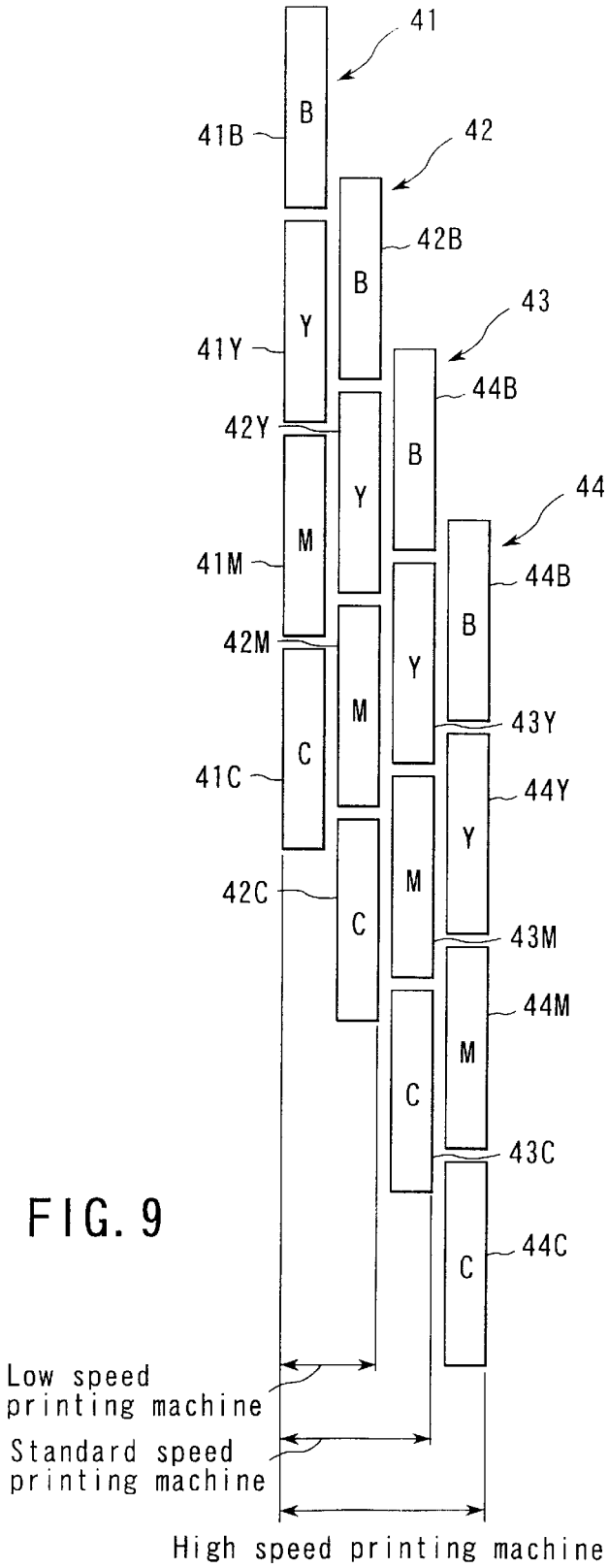
FIG. 9 is a schematic illustration of a color ink-jet head according to the fourth embodiment of the invention, showing the configuration thereof.

FIG. 9 is a schematic illustration of a color ink-jet head according to the fourth embodiment of the invention, showing the configuration thereof. As shown in FIG. 9, this embodiment of color ink-jet head comprises a total of four head blocks, each having four head units for four different colors. All the four head units show a same length, a same number of nozzles arranged at a same and identical pitch.

More specifically, the first head block 41 is formed by arranging a head unit 41B for black ink, a head unit 41Y for yellow ink, a head unit 41M for magenta ink and a head unit 41C for cyan ink in a direction perpendicular to the printing direction (as indicated by arrow A in FIG. 9) in the above mentioned order with a predetermined gap separating any two adjacent head units thereof.

Similarly, the second head block 42 is formed by arranging a head unit 42B for black ink, a head unit 42Y for yellow ink, a head unit 42M for magenta ink and a head unit 42C for cyan ink in a direction perpendicular to the printing direction in the above mentioned order with a predetermined gap separating any two adjacent head units thereof.

Likewise, the third head block 43 is formed by arranging a head unit 43B for black ink, a head unit 43Y for yellow ink, a head unit 43M for magenta ink and a head unit 43C for cyan ink in a direction perpendicular to the printing direction in the above mentioned order with a predetermined gap separating any two adjacent head units thereof.

Finally, the fourth head block 44 is formed by arranging a head unit 44B for black ink, a head unit 44Y for yellow ink, a head unit 44M for magenta ink and a head unit 44C for cyan ink in a direction perpendicular to the printing direction in the above mentioned order with a predetermined gap separating any two adjacent head units thereof.

Figure 10A:
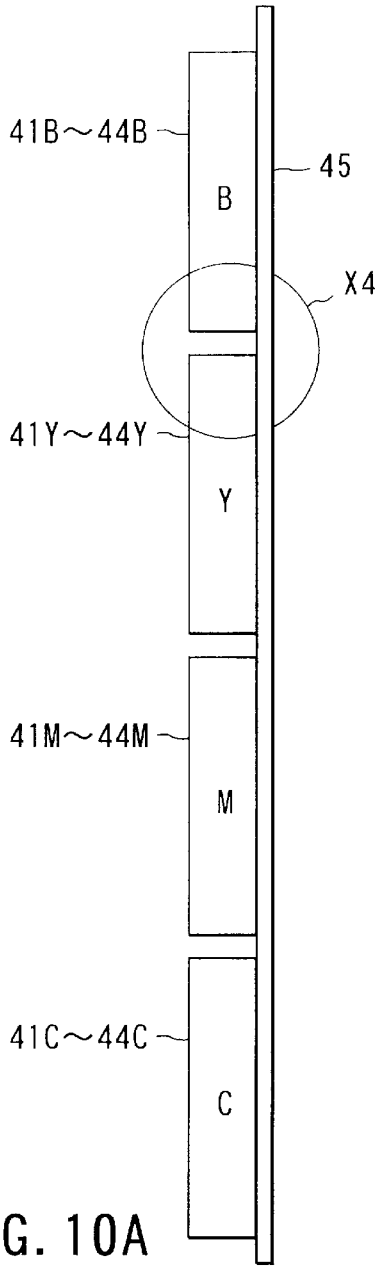
FIGS. 10A and 10B are schematic illustrations of head blocks that can be used for the embodiment of FIG. 9, showing the configuration thereof.

Then, as shown in FIG. 10A, in each of the head blocks 41, 42, 43, 44, the head unit 41B, 42B, 43B or 44B for black ink, the head unit 41Y, 42Y, 43Y or 44Y, whichever appropriate, for yellow ink, the head unit 41M, 42M, 43M or 44M, whichever appropriate, for magenta ink and the head unit 41C, 42C, 43C or 44C, whichever appropriate, for cyan ink are all located at a side of the block base 45, the head units being arranged in the order of black (B), yellow (Y), magenta (M) and cyan (C) in a direction perpendicular to the printing direction as shown in FIG. 10A.

Figure 10B:
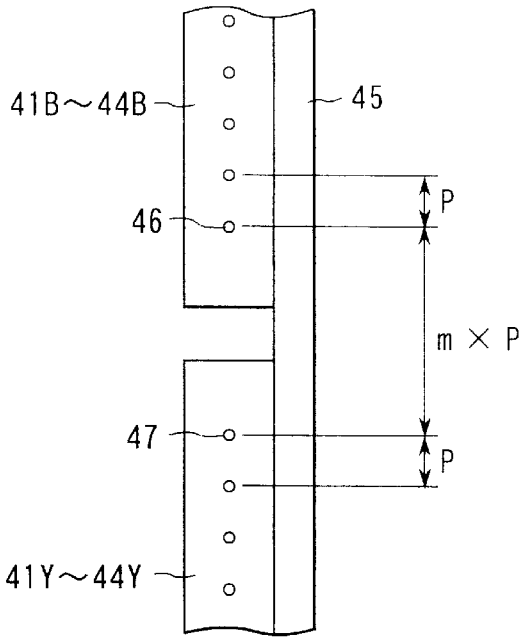

FIG. 10B is an enlarged schematic illustration of a part of the embodiment, surrounded by a circle and indicated by $X_4$ in FIG. 10A. Referring to FIG. 10B, the extreme end nozzles 46 of the head unit 41B, 42B, 43B or 44B for black ink and the extreme end nozzles 47 of the head unit 41Y, 42Y, 43Y or 44Y, whichever appropriate, are arranged at a same and identical pitch of P but the head unit 41B, 42B, 43B or 44B for black ink and the head unit 41Y, 42Y, 43Y or 44Y, whichever appropriate, for yellow ink are separated from each other by m (an integer) time of the nozzle pitch P at the respective ends located close to each other.

The above described positional relationship applies equally to the nozzles of the head unit 41Y, 42Y, 43Y or 44Y, whichever appropriate, for yellow ink and those of the head unit 41M, 42M, 43M or 44M, whichever appropriate, for magenta ink and to the nozzles of the head unit 41M, 42M, 43M or 44M, whichever appropriate, for magenta ink and those of the head unit 41C, 42C, 43C or 44C, whichever appropriate, for cyan ink.

Figure 11:
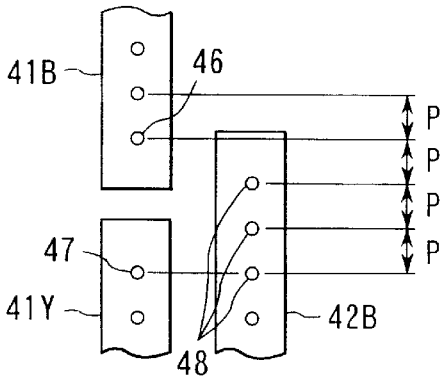
FIG. 11 is a schematic illustration of head blocks that can be used for the embodiment of FIG. 9, showing the positional relationship of nozzles thereof.

Then, the head blocks 41 through 44 are displaced sequentially and slightly relative to each other in a direction perpendicular to the printing direction of the ink-jet head by a distance less than the length of a head unit. As shown in FIG. 11, when viewed from a lateral side, the extreme end nozzle 46 at the tail end of the head unit 41B for black ink that is located at the tail end of the first head block 41 and the extreme end nozzle 47 at the front end of the head unit 41Y for yellow ink are separated by such a distance that the two nozzles 48 at the front end of the head unit 42B for black ink that is located at the tail end of the second head block 42 are snugly placed between them and the distance separating the nozzles 46 and 48 and the distance separating the nozzles 48 and 47 agree with the pitch P of arrangement of the nozzles of the head units.

The second head block 42 and the third head block 43, and the third head block 43 and the fourth head block 44 show a same positional relationship.

With the color ink-jet head 1 having the above described configuration, four head units are arranged in a direction perpendicular to the printing direction of the ink-jet head for each of the ink colors of black (B), yellow (Y), magenta (M) and cyan (C), although the head units of a same color may be separated considerably in the printing direction, and all the nozzles are arranged at a same and identical pitch of P. Therefore, a cycle of printing operation is carried out properly with a width substantially equal to that of four head units arranged side by side when the timing of ejection of ink of each color from the nozzles of each head unit is properly controlled. Thus, a high speed printing machine can be realized by using this embodiment of color ink-jet head according to the invention. When, for example, 400 nozzles are used for ink of each color in a high speed printing machine comprising this embodiment of color ink-jet head, n=4 will be selected for it. There may be cases where dummy nozzles are used. Then, the total number of nozzles may not be exactly dividable by n and equal to 402 for ink of each color for instance with two dummy nozzles. However, no problem arises when n=4 is used for such a case.

As pointed out above, all the head blocks have a same and identical configuration. Therefore, if the color ink-jet head is made to comprise three head blocks by removing a head block from the above described embodiment of color ink-jet head, a cycle of printing operation is carried out properly with a width substantially equal to that of three head units arranged side by side when the timing of ejection of ink of each color from the nozzles of each head unit is properly controlled. Then, a standard speed printing machine can be realized by using such a color ink-jet head. Furthermore, if the color ink-jet head is made to comprise only two head blocks by removing one head block from the above described embodiment of color ink-jet head, a cycle of printing operation is carried out properly with a width substantially equal to that of two head units arranged side by side when the timing of ejection of ink of each color from the nozzles of each head unit is properly controlled. Then, a low speed printing machine can be realized by using such a color ink-jet head.

In this way, heads for high speed printing machines, those for standard speed printing machines and those for low speed printing machines can be produced by using different number of head blocks having a same and identical configuration. In other words, it is no longer necessary to produce head blocks dedicated to a high speed printing machine, a standard speed printing machine or a low speed printing machine. Then, color ink-jet heads can be manufactured at low cost to realize a high economic efficiency. Additionally, since all the head units of each of the head blocks 41 through 44 are arranged at a same side of the corresponding block base 45, the width of the head block can be minimized in the printing direction to consequently minimize the width of the entire head.

Either of the above described two types, the multi-drop type or the volume control type, can be applied to each head unit of each head block of this embodiment of color ink-jet head for the purpose of gradation control.

(Fifth Embodiment)

Figure 12:
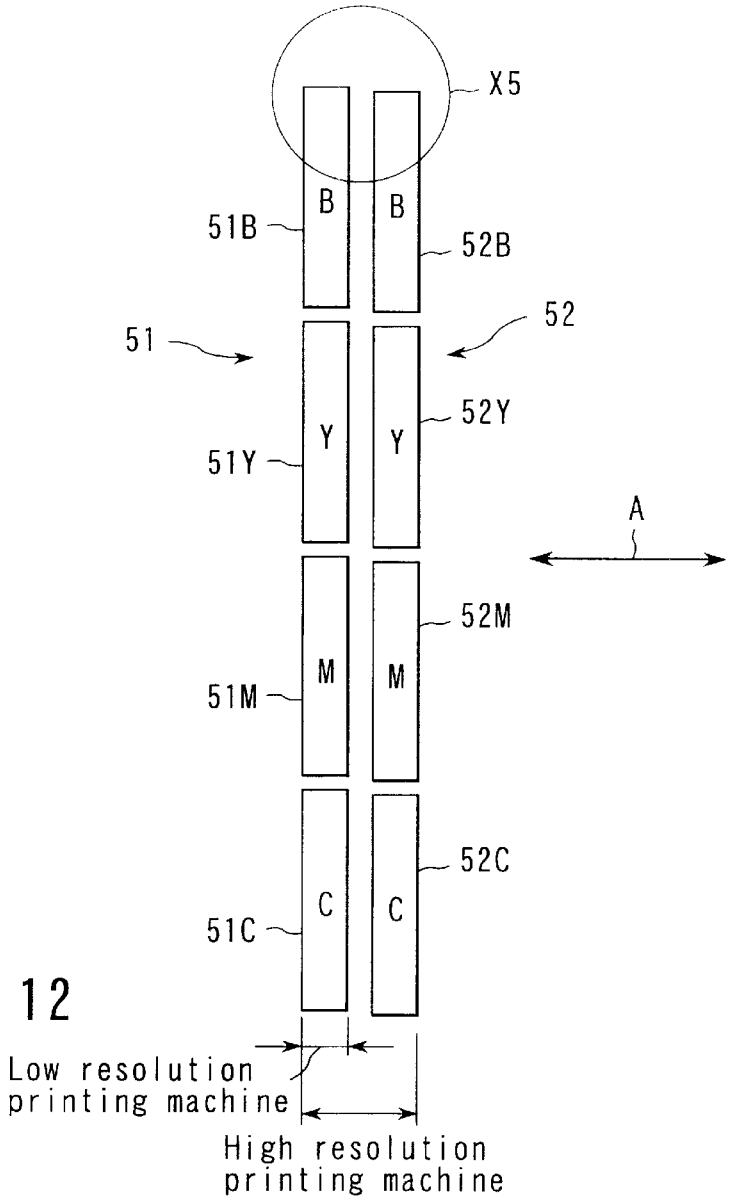
FIG. 12 is a schematic illustration of a color ink-jet head according to the fifth embodiment of the invention, showing the configuration thereof.

FIG. 12 is a schematic illustration of a color ink-jet head according to the fifth embodiment of the invention, showing the configuration thereof. This embodiment of color ink-jet head comprises two head blocks, each having four head units for four different colors. The four head units show a same length, a same number of nozzles arranged at a same and identical pitch.

More specifically, the first head block 51 is formed by arranging a head unit 51B for black ink, a head unit 51Y for yellow ink, a head unit 51M for magenta ink and a head unit 51C for cyan ink in a direction perpendicular to the printing direction (as indicated by arrow A in FIG. 12) in the above mentioned order.

Similarly, the second head block 52 is formed by arranging a head unit 52B for black ink, a head unit 52Y for yellow ink, a head unit 52M for magenta ink and a head unit 52C for cyan ink in a direction perpendicular to the printing direction in the above mentioned order.

Figure 13:
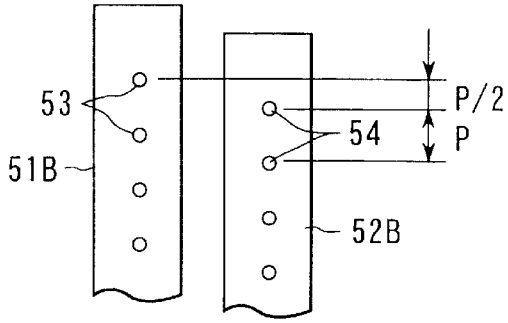
FIG. 13 is a schematic illustration of head blocks that can be used for the embodiment of FIG. 12, showing the positional relationship of nozzles thereof.
Figure 14A:
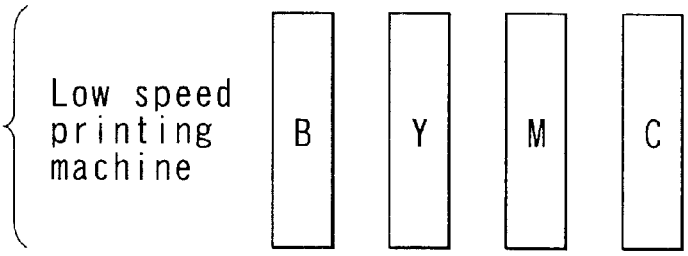
FIGS. 14A through 14C are schematic illustrations of a known color ink-jet head, showing the configuration thereof.
Figure 14B:
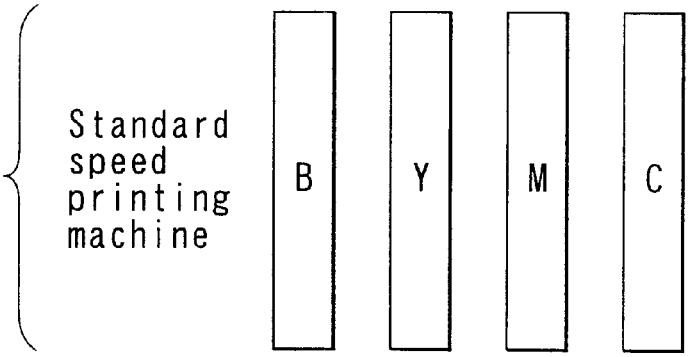
Figure 14C:
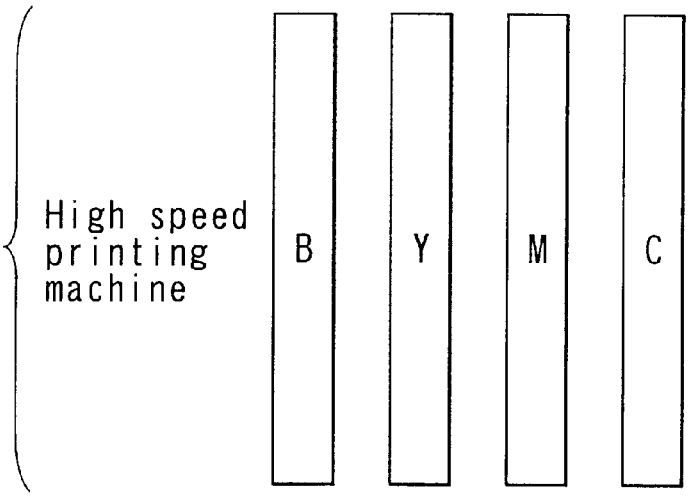
Figure 15A:
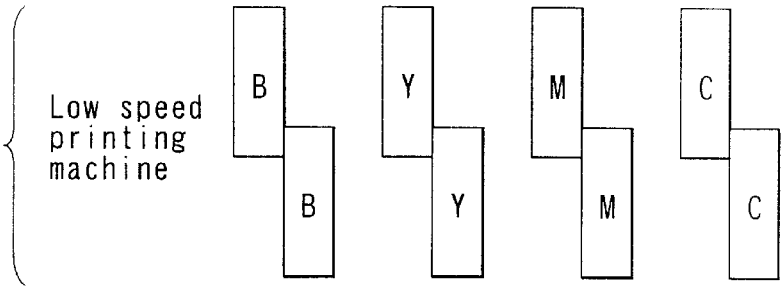
FIGS. 15A through 15C are schematic illustrations of another known color ink-jet head, showing the configuration thereof.
Figure 15B:
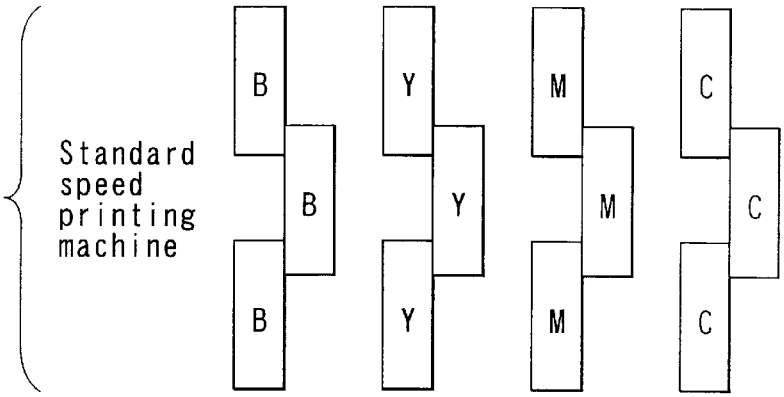
Figure 15C:
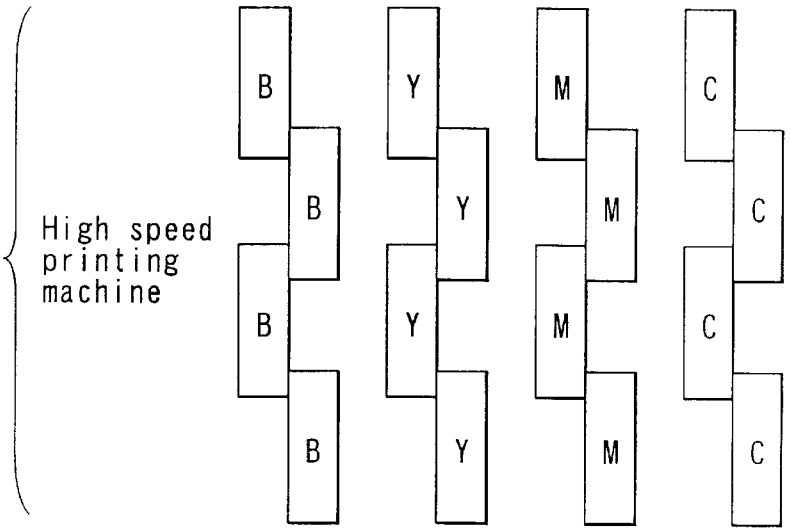

The head blocks 51, 52 are displaced slightly in a direction perpendicular to the printing direction. FIG. 13 is a schematic illustration of head blocks that can be used for the embodiment of FIG. 12, showing the positional relationship thereof. Note that FIG. 13 is an enlarged schematic illustration of a part of the embodiment, surrounded by a circle and indicated by $X_5$ in FIG. 12. Referring to FIG. 13, the nozzles 53 of the head unit 51B for black ink of the first head block 51 are displaced respectively from the corresponding nozzles 54 of the head unit 52B for black ink of the second head bock 52 by a half of the pitch P at which the nozzles 53 and 54 are arranged.

Similarly, the nozzles of the head unit 51Y for yellow ink, those of the head unit 51 M for magenta ink and those of the head unit 51C for cyan ink of the first head block 51 are displaced respectively from the corresponding nozzles of the head unit 52Y for yellow ink, those of the head unit 52M for magenta ink and those of the head unit 52C for cyan ink of the second head block 52 by a half of the pitch P of arrangement of the nozzles.

With this arrangement, the pixels printed by the first head block 51 and those printed by the second head block 52 are located alternately as viewed in the printing direction so that pixels can be printed at a pitch of P/2, or twice of the resolution of each head block. In other words, a high resolution printing machine can be realized by using two identical head blocks. Differently stated, a low resolution printing machine can be realized by using a single head block.

An even higher resolution can be realized by using three identical head blocks that are arranged in such a way that the nozzles of each of the head blocks are displaced from those of the remaining head blocks by one-third of the pitch P of arrangement of the nozzles of each head block. Generally speaking, a color ink-jet head showing a resolution n times as high as that of a single head block can be realized by using n head blocks (n=an integer equal to or greater than two) and displacing the nozzles of each of the head blocks from those of the remaining head blocks by 1/n of the pitch P of arrangement of the nozzles of each head block.

Thus, a high resolution printing machine or a low resolution printing machine can be manufactured simply by using an appropriate number of head blocks having a same and identical configuration. Then, color ink-jet heads can be manufactured at low cost to realize a high economic efficiency.

Either of the above described two types, the multi-drop type or the volume control type, can be applied to each head unit of each head block of this embodiment of color ink-jet head for the purpose of gradation control.

Additional advantages and modifications will readily occur to those skilled in the art. Therefore, the invention in its broader aspect is not limited to the specific details and representative embodiments shown and described herein. Accordingly, various modifications may be made without departing from the spirit or scope of the general inventive concept as defined by the appended claims and their equivalents.

What is claimed is:

1. A color ink-jet head comprising:

a plurality of head units each having 1/n of a total number of nozzles predetermined as a maximum number to jet ink of one color in one scanning, where n is an integer equal to or greater than 2, and wherein the nozzles of each of the head units are arranged at a same pitch; and a plurality of head blocks each having at least as many said head units as a number of different ink colors to be used for the ink-jet head;

wherein said head units are provided for holding respective inks of the different colors and are arranged in a direction perpendicular to a printing direction of said ink-jet head;

wherein a predetermined number of said head blocks are arranged in the printing direction in such a manner that no head units of a same color are aligned in the printing direction, and said head blocks execute printing for said predetermined number of head blocks multiplied by 1/n of a printing width in one scanning.

2. The color ink-jet head according to claim 1, wherein an extreme end nozzle at an end of each of the head units and a corresponding extreme end nozzle at an opposite end of an adjacent head unit are separated by a distance equal to the pitch at which the nozzles of each of the head units are arranged.

3. The color ink-jet head according to claim 2, wherein:

an order of arrangement of the ink colors in the head units of each head block is identical for all of the head blocks; and said n head blocks are sequentially displaced by a distance substantially equal to a head unit length in the direction perpendicular to the printing direction; and the nozzles of a second extreme end head unit at an end of at least one of the head blocks are respectively aligned with corresponding nozzles of an extreme end head unit at a corresponding end of an immediately adjacent head block in the printing direction.

4. The color ink-jet head according to claim 2, wherein:

an order of arrangement of the ink colors in the head units of each head block is identical for all of the head blocks; and the nozzles of the head units of each head block are displaced by 1/n relative to each other.

5. The color ink-jet head according to claim 2, wherein:

the nozzles of each head unit of each head block are arranged in a single line running in the printing direction; and the head blocks are arranged such that no two head units of a same color come on a same line in the printing direction.

6. The color ink-jet head according to claim 1, wherein an extreme end nozzle at an end of each of the head units and a corresponding extreme end nozzle at an opposite end of an adjacent head unit are separated by a distance equal to the pitch at which the nozzles of each of the head units are arranged multiplied by an integer.

7. The color ink-jet head according to claim 6, wherein:

an order of arrangement of the ink colors in the head units of each head block is identical for all of the head blocks; and said n head blocks are sequentially displaced by a distance substantially equal to a head unit length in a direction perpendicular to the printing direction.

8. The color ink-jet head according to claim 6, wherein:

an order of arrangement of the ink colors in the head units of each head block is identical for all of the head blocks; and the nozzles of the head units of each head block are displaced by 1/n relative to each other.

9. The color ink-jet head according to claim 1, wherein said head blocks are provided with respective block bases and the head units of each head block are arranged alternately at opposite sides of the respective block bases.

10. The color ink-jet head according to claim 9, wherein an extreme end nozzle at an end of each of the head units and a corresponding extreme end nozzle at an opposite end of an adjacent head unit are separated by a distance equal to the pitch at which the nozzles of each of the head units are arranged.

11. The color ink-jet head according to claim 10, wherein:

an order of arrangement of the ink colors in the head units of each head block is identical for all of the head blocks; and said n head blocks are sequentially displaced by a distance substantially equal to a head unit length in the direction perpendicular to the printing direction; and the nozzles of a second extreme end head unit at an end of at least one of the head blocks are respectively aligned with corresponding nozzles of an extreme end head unit at a corresponding end of an immediately adjacent head block in the printing direction.

12. The color ink-jet head according to claim 10, wherein:

an order of arrangement of the ink colors in the head units of each head block is identical for all of the head blocks; and the nozzles of the head units of each head block are displaced by 1/n relative to each other.

13. The color ink-jet head according to claim 10, wherein:

the nozzles of each head unit of each head block are arranged in a single line running in the printing direction; and the head blocks are arranged such that no two head units of a same color come on a same line in the printing direction.

14. The color ink-jet head according to claim 1, wherein said head blocks are provided with respective block bases and the head units of each head block are arranged at a lateral side of the respective block bases.

15. The color ink-jet head according to claim 14, wherein an extreme end nozzle at an end of each of the head units and a corresponding extreme end nozzle at an opposite end of an adjacent head unit are separated by a distance equal to the pitch at which the nozzles of each of the head units are arranged.

16. The color ink-jet head according to claim 15, wherein:

an order of arrangement of the ink colors in the head units of each head block is identical for all of the head blocks; and said n head blocks are sequentially displaced by a distance substantially equal to a head unit length in the direction perpendicular to the printing direction; and the nozzles of a second extreme end head unit at an end of at least one of the head blocks are respectively aligned with corresponding nozzles of an extreme end head unit at a corresponding end of an immediately adjacent head block in the printing direction.

17. The color ink-jet head according to claim 15, wherein:

an order of arrangement of the ink colors in the head units of each head block is identical for all of the head blocks; and the nozzles of the head units of each head block are displaced by 1/n relative to each other.

18. The color ink-jet head according to claim 15, wherein:

the nozzles of each head unit of each head block are arranged in a single line running in the printing direction; and the head blocks are arranged such that no two head units of a same color come on a same line in the printing direction.

19. A color ink-jet head comprising:

a plurality of head units each having 1/n of a total number of nozzles, where n is an integer equal to or greater than 2, and wherein the nozzles of each of the head units are arranged at a same pitch; and a plurality of head blocks each having at least as many said head units as a number of different ink colors to be used for the ink-jet head;

wherein said head units are provided for holding respective inks of the different ink colors and are arranged in a direction perpendicular to a printing direction of the ink-jet head;

wherein a total of n said head blocks are arranged in the printing direction;

wherein an order of arrangement of the ink colors filled in the head units of each head block is identical for all of the head blocks;

wherein said n head blocks are sequentially displaced by a distance substantially equal to a head unit length in the direction perpendicular to the printing direction; and wherein the nozzles of a second extreme end head unit at an end of at least one of the head blocks are respectively aligned with corresponding nozzles of an extreme end head unit at a corresponding end of an immediately adjacent head block in the printing direction.

20. A color ink-jet head comprising:

a plurality of head units each having 1/n of a total number of nozzles, where n is an integer equal to or greater than 2, and wherein the nozzles of each of the head units are arranged at a same pitch; and a plurality of head blocks each having at least as many said head units as a number of different ink colors to be used for the ink-jet head;

wherein said head units are provided for holding respective inks of the different ink colors and are arranged in a direction perpendicular to a printing direction of the ink-jet head;

wherein a total of n said head blocks are arranged in the printing direction;

wherein an extreme end nozzle at an end of each of the head units and a corresponding extreme end nozzle at an opposite end of an adjacent head unit are separated by a distance equal to the pitch at which the nozzles of each of the head units are arranged multiplied by an integer;

wherein an order of arrangement of the ink colors in the head units of each head block is identical for all of the head blocks;

wherein said n head blocks are sequentially displaced by a distance substantially equal to a head unit length in the direction perpendicular to the printing direction.

21. A color ink-jet head comprising:

a plurality of head units each having 1/n of a total number of nozzles, where n is an integer equal to or greater than 2, and wherein the nozzles of each of the head units are arranged at a same pitch; and a plurality of head blocks each having at least as many said head units as a number of different ink colors to be used for the ink-jet head;

wherein said Adobehead units are provided for holding respective inks of the different ink colors and are arranged in a direction perpendicular to a printing direction of the ink-jet head;

wherein a total of n said head blocks are arranged in the printing direction;

wherein said head blocks are provided with respective block bases and the head units of each head block are arranged alternately at opposite sides of the respective block bases.

22. A color ink-jet head comprising:

a plurality of head units each having 1/n of a total number of nozzles, where n is an integer equal to or greater than 2, and wherein the nozzles of each of the head units are arranged at a same pitch; and a plurality of head blocks each having at least as many said head units as a number of different ink colors to be used for the ink-jet head;

wherein said head units are provided for holding respective inks of the different ink colors and are arranged in a direction perpendicular to a printing direction of the ink-jet head;

wherein a total of n said head blocks are arranged in the printing direction;

wherein said head blocks are provided with respective block bases and the head units of each head block are arranged at a lateral side of the respective block bases.

* * * * *